United States Patent [19]

Bennett et al.

[11] B 3,994,610

[45] Nov. 30, 1976

[54] SKID RESISTANCE OF ASPHALT SURFACE ROADS

[75] Inventors: Richard J. Bennett; Ollie G. Buck; John L. Buster, all of Bartlesville, Okla.

[73] Assignee: Phillips Petroleum Company, Bartlesville, Okla.

[22] Filed: Jan. 17, 1974

[21] Appl. No.: 434,206

[44] Published under the second Trial Voluntary Protest Program on February 3, 1976 as document No. B 434,206.

[52] U.S. Cl. ..... 404/77; 404/79

[51] Int. Cl.[2] ..... E01C 7/06

[58] Field of Search ..... 404/79, 80, 95, 72, 404/19, 77; 106/284; 264/31

[56] References Cited

UNITED STATES PATENTS

| | | | |
|---|---|---|---|
| 121,082 | 11/1871 | Burlew | 106/284 |
| 237,662 | 2/1881 | DeSmedt | 208/4 |
| 1,512,125 | 10/1924 | Mende | 404/79 |
| 1,661,828 | 3/1928 | Hopkinson | 264/31 |
| 2,182,837 | 12/1939 | Bacon | 404/79 |
| 2,254,463 | 9/1941 | Wells | 404/95 |
| 2,686,166 | 8/1954 | Taylor | 404/72 X |

*Primary Examiner*—Nile C. Byers

[57] ABSTRACT

Asphalt surface roads are subjected to an oxidizing treatment, e.g., flame treatment, to improve resistance thereof to skidding on the surface thereof.

8 Claims, No Drawings

SKID RESISTANCE OF ASPHALT SURFACE ROADS

This invention relates to an improvement to skid resistance of an asphalt surface road. In one of its aspects the invention relates to the improvement of skid resistance of a roadway to which oil-rubber emulsion or excess asphalt cement in asphaltic concrete has been applied. In still another aspect the invention relates to the improvement of resistance to skidding of a road surface as herein described, the skidding being caused by oil leaks thereonto.

In one of its concepts the invention provides a process for the oxidizing of a road surface to improve its resistance to skidding. In another of its concepts, the invention provides a process for the treatment under oxidizing conditions of a roadway which as been treated with a rubberizing or asphalt or oil-rubber asphalt emulsion. In a still further concept of the invention, it provides for heat treatment, under oxidizing conditions, of a roadway as herein described. The invention is applicable to the treatment of surfaces other than roadway surfaces to improve the skid resistant and concomitant properties thereof.

The reasons for the occasional reduction in skid resistance are not yet clearly understood. However, excess application of the oil-rubber emulsion or excess asphalt cement in the asphaltic concrete mix might result in a neat asphalt covering of the surface aggregate. Oil leaks from trucks and cars also contribute to a slick surface. Normal weathering which will embrittle the asphalt surface and expose fresh aggregate by traffic abrasion may restore some skid resistance but this is a slow process and the dangerous skid level may persist for some time.

We have found that an oxidizing or heat treatment will restore skid resistance to practically the same level as the original surface, before the skid resistance was impaired. Treatment can be applied as quickly as suitable equipment is made available after the discovery of a dangerous skid tendency, the risk of skid-based accidents can be greatly reduced. We have found that the improvement in skid resistance as by flame treatment of asphalt surface roads, especially those surfaces which have been treated with a rubberizing or asphalt emulsion, is obtained by suitably distancing a heat source or flame under oxidizing conditions from the surface.

Thus we have exposed surfaces, as herein contemplated, to heat at a distance from impingement of a flame to the surface to a distance at which surface treatment is barely effective, about 6–24 inches depending on length of flame or other heat source, for a period of time sufficient to effect thermal oxidation, i.e., 1 second to 5 minutes, but insufficient to melt or fuse any substantial layer of the asphalt or to cause excessive flushing of the asphalt cement.

An object of this invention is to improve the skid resistance of a surface. Another object of this invention is to alter the physical characteristics or skid resistance of a surface as of an asphalt surfaced road or pavement. A further object of this invention is to improve the skid resistance of a surface which has been treated with a rubberizing emulsion. Another object of this invention is to improve the skid resistance of a surface which has been treated with an asphalt-containing emulsion. Further, an object of this invention is to improve the skid resistance of an asphalt surfaced road or pavement. A still further object of this invention is to improve the skid resistance of an asphalt surface road which has been treated with a rubberizing or asphalt-containing emulsion.

In lieu of rubber applied as an emulsion other rubber compositions, e.g., a solution can be used. Thus, an asphalt emulsion, a rubber emulsion and/or a rubber solution can be used to provide the surface which is treated according to the invention.

Other aspects, concepts, objects and the several advantages of the invention are apparent from a study of this disclosure and the appended claims.

According to the present invention, improvement in skid resistance of a surface is obtained by subjecting the same to an oxidizing treatment.

Further, according to the invention, a surface pavement or road is given improved skid resistance by subjecting the same under oxidizing conditions to a flame, electric heating or chemical oxidizing treatment.

The invention is primarily, most readily applied using as the oxidizing treatment a flame treatment of an asphalt surface road especially one whose surface has been treated with a rubberizing or asphalt-containing emulsion. It will be understood by those skilled in the art in possession of this disclosure having studied the same that, though it is not known precisely just how the treatment affects the surface and therefore effects the improved skid resistance, a concept basic to the invention is that the surface shall be at least in part oxidized under conditions to effect the oxidizing without unacceptably damaging the surface.

Thus, according to the invention there can be used under oxidizing conditions a flame created by burning a fuel, an electrically heated heating unit or an oxidizing chemical, for example, a peroxide, dichromate and sulfuric acid, etc.

A very simple type of heating apparatus which can be used is a truck mounted agricultural weed burner fueled by liquid propane. The burner is adjusted to deliver a uniform flame, which is an oxidizing flame to the surface to be flame treated.

It will be understood that reference to oxidizing conditions in this specification and in the claims appended hereto simply means that oxidation conditions exist. Although oxidizing conditions exist, it is possible that during the contact of the surface with the heat or other treatment reactions of the substance of the surface in and of itself or with vapors or gases extant during the treatment might be better described as something other than oxidizing reactions. As noted, the precise mechanism which operates or mechanisms which operate to improve the skid resistance are not known to an extent sufficient to describe the same.

It is known that flame treatment will "burn" or carbonize at the surface the organic binder present in the surface material. If there is formation of a friable coke-like residue this is not considered objectionable because it will readily abrade under normal traffic use. Whether this coke-like residue contributes materially or significantly to the improvement in skid resistance is not known.

Emulsions which can be used to treat asphaltic surfaces which then can be treated according to the present invention are disclosed in U.S. Pat. No. 3,577,250 of May 4, 1971, the disclosure of which is incorporated herein by reference.

EXAMPLE I

Several sections of a heavily travelled road in Oklahoma were treated with a rubberizing asphalt treatment emulsion having the following compositions:

| Typical Emulsion | Weight Percent |
|---|---|
| 1.Rubber | 18.0 |
| 2.$SO_2$ Extract Oil | 42.0 |
| 3.Oronite, NI-W | 2.5 |
| 4.Automate Blue (Oil Blue A) | 0.025 |
| 5.Cyanox SS | 0.18 |
| 6.Redicote E-1 | 0.5 |
| 31.5% HCl | 0.45 |
| Methanol | 2.0 |
| 7.Saponin | 0.06 |
| Water | 34.285 |
| | 100.00 |

In the following tabulation corresponding numbers explain further the ingredients of the typical emulsion:

1. A butadiene/styrene block copolymer, 60:40 butadiene:styrene with 40% block polystyrene (Solprene$^R$ 414, Phillips Petroleum Company).
2. 10 Kansas City extract oil, viscosity 45 SUS at 210°F. Aromatic content 73 wt. percent.
3. Water suluble nonionic surfactant of the alkylphenolethylene oxide type (Oronite Chemical Co.)
4. 1,4-dialkylaminoanthraquinone, a blue dye.
5. 2,2′-methylene-bis(4-methyl-6-t-butyl phenol).
6. Cationic emulsifier (Armour and Co.)
7. Surfactant (S. B. Penick & Co.)

The emulsion was diluted with 2 parts of water to give 6 percent by weight rubber content and applied by means of a spray apparatus used on conventional asphalt distributor trucks. Three sections were treated with the emulsion, one section was left untreated as control and one was treated with a modified emulsion as shown below.

Skid numbers were measured on all sections in the course of one day and again just prior to the flame treatment, then two days later and two weeks later. Wet skid resistance tends to go up as the temperature drops, so that the data should be taken at approximately the same temperature.

The four sections were treated as follows:

A — no treatment.

B — emulsion applied at the rate of 0.15 gal/sq. yd. — no sand overlay.

C* — emulsion applied at the rate of 0.15 gal/sq. yd. — no sand overlay.

D — emulsion applied at the rate of 0.10 gal/sq. yd. — no sand overlay.

E — emulsion applied at the rate of 0.15 gal/sq. yd. — sanded.

*Special emulsion using 9 wt. percent rubber, 31% $SO_2$ extract oil, 20% 90 penetration asphalt, with the minor ingredients as given above, diluted two parts emulsion to one part water to maintain 6 percent by weight of rubber in the final composition applied to the asphalt.

Section C and the outside two-thirds of section E were flame treated using a weed burner with AFCA burner heads. The fuel was liquid propane. The burners were set about 8 inches above the road surface and the flame was adjusted to impinge directly on the surface. The flame was moved along the surface of the road at such a rate that the surface appeared to be slightly carbonized or oxidized. Deep heating of the asphalt surface was avoided in order to prevent flushing or bleeding of the asphalt. Heating depth was estimated at less than one inch, probably no more than ½ inch. Section E was brushed lightly with a nylon bristled power sweeper.

The skid number was determined as follows:

A track test 5th wheel (Laboratory Equipment Corp.) was attached to a 1971 Plymouth Fury III using tires having the ASTM designation E 249-66 (for skid tests). The apparatus includes a digital read-out system that shows the speed (MPH) of the auto at the time of the brake lockup and the skid distance in feet from lockup to complete stoppage of the test vehicle.

In the tables below Skid Number is a value calculated as follows:

$$\text{Skid Number} = \frac{V^2(\text{speed in MPH}) \times 100}{30 \times \text{skid distance in feet}}$$

In making the tests, the pavement strip was thoroughly wetted with water using a water spray truck. The skid test vehicle followed the water track as closely as possible. The average speed of the vehicle: 40 mph; upon entering the wet test area the car wheels were locked by applying emergency pressure to the brakes. The digital read-out recorded the speed at the moment the wheels locked and began recording the skid distance. The recorded data were used in the above formula.

The data are summarized below:

TABLE I

| Skid | Temperature °F | A(Control) | Rubber Emulsion Treated Section Not Flame Treated B | D | Flame Treated C | E |
|---|---|---|---|---|---|---|
| | | Before Flame Treatment | | | | |
| Original Skid Resistance | 80–98 | 45.9 | 34.6 | 37.0 | 31.9 | 34.2 |
| Six months later (Before flame treatment of Sections C & E) | 48 | NM[1] | NM | NM | 38.9 | 44.4 |
| | | After Flame Treatment | | | | |
| (Two days after flame treatment) | 37 | 55.1 | NM | NM | 51.7 | 50.7 |
| (Two weeks after flame treatment) | 54 | 50.1 | 42.2 | 45.7 | 48.5 | 50.1 |

[1]NM = not measured.

The data show a reduction in skid number of all sections treated with the rubberizing emulsion, i.e., increased skid tendency compared to the untreated section A. After flame treatment of sections C and E, the treated sections showed a considerable improvement in skid resistance. A measurement after two weeks of all sections showed that flame treated sections C and E had skid resistance to or nearly equal to the untreated section A, while the rubberize, non-flame treated sections had considerably lower skid numbers than the control at the same temperature.

EXAMPLE II

In another test, a road section was flame treated as set forth below, to which a richer asphalt cement had been applied and which had been treated excessively with the rubberizing emulsion at a rate of 0.3 gals./sq. yd., rather than 0.1 – 0.15 gals./sq. yd., which is recommended.

As a result of the richness of the asphalt cement and excessive treatment, the cement could be gouged out, as with a fingernail, and the sections have skid numbers generally below 35.

Thus, six test sections, approximately 300 feet long, to which excessive asphalt cement emulsion had been applied, as just described, were flame treated. An average of six passes per section was made. The flame bar was six feet wide and since each lane was about twelve feet wide, this required an inside and outside burn on each lane area. Flame oxidation did not give an improvement in skid resistance on the six areas treated. The road surface after flame treatment tended to flush and bleed rather than give the appearance of carbonizing as was observed in tests, data from which are reported in Table I.

The data are summarized in Table II; it can be noted that most of the skid numbers are about 35. The flame treatment showed a slight improvement in only one of the sections (strip 13). This was the strip in which the emulsion had been applied in a single application and its original skid number was also above 35. In the other strips tested, the emulsion had been applied at approximately 0.1 gal./sq. yd. followed by a second application, after penetration of the first, of approximately 0.2 gals./sq. yd.

It is now considered probable that the rich mix and the excessive treatment with the rubberizing emulsion led to a loss in original skid number, from about 53–54 to less than 35 and that the flame treatment led to flushing and bleeding of the excess asphalt rather than to the desired carbonizing effect which had been noted in the earlier test (Example I).

Therefore, in order for such treatment to be effective, a properly treated asphalt surface is desirable. However, superficial oil slicks on concrete surface roads, for example, are thought to be very amenable to the oxidizing treatment.

TABLE II

| Strip Number | Outside Lane Vehicle Passes | Original Test[a] | Circa 6 mos. | Before Burn Circa 7 mos. | SKID NUMBER After Burn Circa 7 mos. | After Burn Circa 7 mos. |
|---|---|---|---|---|---|---|
| 1 | 300,000 | 33.9 | — | — | — | — |
| 1 | 400,000 | — | 36.8 | 33.3 | — | 32 |
| 2 | 300,000 | 30.5 | — | — | — | — |
| 2 | 400,000 | — | 35.4 | 33.7 | 29.3 | 29 |
| 9 | 300,000 | 24.0 | — | — | — | — |
| 9 | 400,000 | — | 33.4 | 29.0 | 26.0 | 25.4 |
| 13 | 300,000 | 37.7 | — | — | — | — |
| 13 | 400,000 | — | 46.6 | 40.5 | — | 42.8 |
| | Inside Lane Vehicle Passes | | | | | |
| 5 | 30,000 | 35.5 | — | — | — | — |
| 5 | 40,000 | — | 36.8 | 38.0 | 37.5 | 35.8 |
| 6 | 30,000 | 35.3 | — | — | — | — |
| 6 | 40,000 | — | 36.8 | 33.7 | — | 36.4 |
| | Outside Lane Vehicle Passes | | | | | |
| 11[b] | 300,000 | 28.0 | — | — | — | — |
| 11[b] | 400,000 | — | 38.2 | 31.3 | — | 31[b] |

[a]Originally the untreated control sections had an average skid number of 53.0 for the inside lane and 57.9 for the outside lane.
[b]This was the control Petroset AT emulsion treated section which was not flame treated.

Reasonable variation and modification are possible within the scope of the foregoing disclosure and the appended claims to the invention the essence of which is that a treatment under oxidizing conditions has been applied to a pavement surface, e.g., an asphalt surface road, especially one which has been treated with a rubberizing and/or asphalt-containing emulsion to improve the skid resistance thereof to make it more nearly equal to that or about as good as that of an original asphalt surface roadway or pavement.

We claim:

1. A method for improving a pavement having an oxidizable surface which is slippery comprising subjecting each portion of the surface of the pavement to flame treatment for one second to 5 minutes with the distance of the flame from the pavement being between impingement and about 24 inches, so that said surface is oxidized sufficiently to improve the skid resistance, said treatment being such that no substantial layer of the surface is melted.

2. A method according to claim 1 wherein the pavement that is subjected to the flame treatment is one which has had a layer of oil-rubber emulsion applied to its surface.

3. A method according to claim 1 wherein the pavement that is subjected to the flame treatment is one which has had a layer of asphalt emulsion applied to its surface.

4. A method according to claim 1 wherein the pavement that is subjected to the flame treatment is one which has had a layer of oil applied to its surface.

5. The method according to claim 1 wherein the flame impinges upon the surface of the pavement.

6. The method according to claim 5 wherein the pavement flame treated is one in which the surface has been previously treated with an oil-rubber emulsion.

7. The method according to claim 5 wherein the pavement flame treated is one which has had its surface previously subjected to treatment with an asphalt emulsion.

8. The method according to claim 5 wherein the pavement flame treated has been previously subjected to a treatment with a coating of oil.

* * * * *